US011885493B2

(12) United States Patent
Lundberg et al.

(10) Patent No.: US 11,885,493 B2
(45) Date of Patent: Jan. 30, 2024

(54) FLUE DAMPER WITH A DRAINAGE PORT

(71) Applicant: Field Controls, L.L.C., Kinston, NC (US)

(72) Inventors: Mark R. Lundberg, Greenville, NC (US); Cory A. Weiss, Warren, MI (US); Kyle R. Glover, Kinston, NC (US)

(73) Assignee: Field Controls, LLC, Kinston, NC (US)

( * ) Notice: Subject to any disclaimer, the term of this patent is extended or adjusted under 35 U.S.C. 154(b) by 640 days.

(21) Appl. No.: 17/023,030

(22) Filed: Sep. 16, 2020

(65) Prior Publication Data

US 2022/0082253 A1 Mar. 17, 2022

(51) Int. Cl.
*F23L 17/14* (2006.01)

(52) U.S. Cl.
CPC ..... *F23L 17/14* (2013.01)

(58) Field of Classification Search
CPC . F23L 17/14; F23L 13/02; F23L 11/00; F23L 11/02; F23L 11/005
USPC ..... 454/1–37, 367
See application file for complete search history.

(56) References Cited

U.S. PATENT DOCUMENTS

| | | | | |
|---|---|---|---|---|
| 6,405,766 | B1 | 6/2002 | Benjey | |
| 6,854,428 | B1 | 2/2005 | Hotton et al. | |
| 7,814,868 | B2 | 10/2010 | Yin et al. | |
| 8,113,823 | B2 | 2/2012 | Guzorek | |
| 9,322,568 | B2 | 4/2016 | Aycock | |
| 9,581,355 | B2 | 2/2017 | Boros et al. | |
| 9,835,330 | B2 | 12/2017 | Guzorek et al. | |
| 9,958,184 | B2 | 5/2018 | Aycock | |
| 10,240,787 | B2 | 3/2019 | Hokanson | |
| 2014/0027660 | A1 | 1/2014 | Guzorek | |
| 2018/0283685 | A1* | 10/2018 | Leung | F16K 15/023 |

* cited by examiner

*Primary Examiner* — Vivek K Shirsat
(74) *Attorney, Agent, or Firm* — SHOOK, HARDY & BACON L.L.P.

(57) ABSTRACT

A flue damper may include a vent pipe with a first side leading to an outlet of the flue damper and a second side leading to an inlet of the flue damper. A damper gate of the flue damper may be movable between an open state and a closed state, where in the open state, the first side of the vent pipe is in fluid communication with the second side, and where in the closed state, the damper gate interrupts fluid communication between the first side and the second side. A drainage port may also be included, and a plug may be movable relative to the drainage port to selectively seal the drainage port when the damper gate remains in the closed state.

20 Claims, 6 Drawing Sheets

420
440
442
438
458
430
466
432
434
460
444
463
436

456
454
452
464
446
448
450
420
440
434
444
432
466

FLUE DAMPER WITH A DRAINAGE PORT

BACKGROUND

Buildings are often heated using a gas-fired heating device or other heating device providing thermal energy for heating a building, herein referred to as a "heating appliance." A typical heating appliance includes a gas burner for generating heat, which may be transferred through a heat exchanger to a living space of a building. Exhaust gasses (or flue gasses) from the heating appliance may the building via an exhaust vent, which may be a pipe leading from the heating appliance to the external atmosphere.

Today's high efficiency heating equipment typically operates under a positive vent pressure during operation (i.e., a pressure above atmospheric pressure). The high pressure generally comes from the use of high pressure fans used to push the combustion flue products through the equipment's heat exchanger. There is generally a need to seal the vents for this type of equipment when two or more heating units are vented to the outside of a building through a common duct. For example, if a first unit is operating, and second and third units are not operating, the flue gases from the first unit may unintentionally flow into the other two heating units. This potential flow of exhaust gases into the non-operating second and third units can cause equipment failures or leakage of flue gases into the occupied building space. Vent pressurization can also occur due to wind loads or other changes to the building's exterior environment.

In prior heating systems, flue dampers have been included. The flue damper may include a movable plate, or "damper gate," located in a pipe that opens and closes to selectively regulate airflow through that pipe. While dampers have been used with success, liquid water (e.g., condensate) may collect on top of the damper under certain conditions. If enough water collects, a motor connected to the damper may be unable to open the damper gate due to the weight and/or pressure of the collected condensate. The present embodiments address this issue.

DESCRIPTION OF THE DRAWINGS

The components in the figures are not necessarily to scale, emphasis instead being placed upon illustrating the principles of the invention. Moreover, in the figures, like referenced numerals designated corresponding parts throughout the different views.

DETAILED DESCRIPTION

Figure 1:
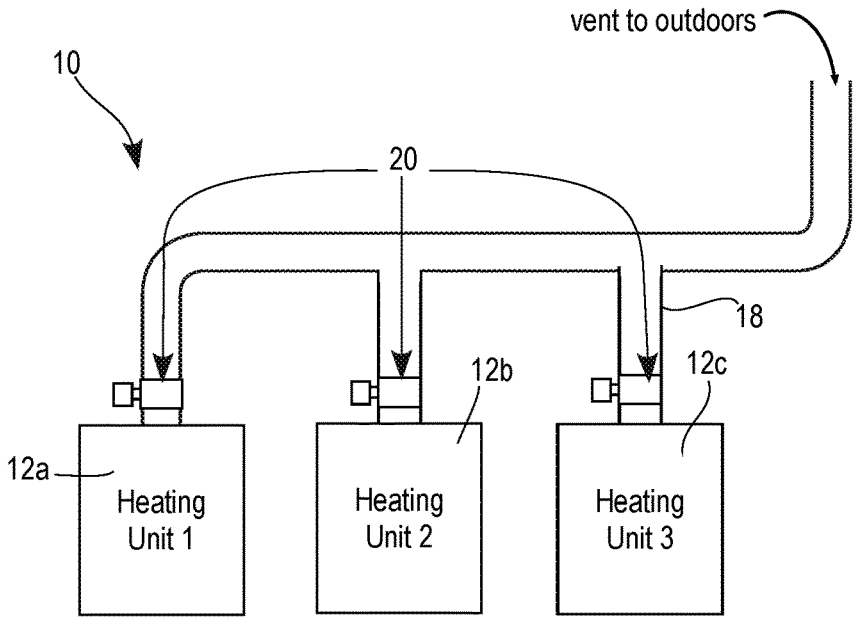
FIG. 1 is an illustration showing an arrangement of heating equipment that may operate under a positive vent pressure (i.e., above atmospheric pressure) during operation in accordance with certain aspects of the present disclosure.

The present embodiments are described with reference to the drawings in which like elements are referred to by like numerals. The relationship and functioning of the various elements of this invention are better understood from the following detailed description. However, the embodiments of the invention are not limited to the embodiments illustrated in the drawings. It should be understood that in certain instances, details have been omitted which are not necessary for an understanding of the present invention, such as conventional fabrication and assembly.

FIG. 1 is an illustration showing an arrangement of heating equipment 10 that operates under a positive (above atmospheric pressure) vent pressure during operation. The high pressure comes from the use of high pressure fans used to push the combustion flue products through the equipment's heat exchanger. Sealing the vents for this type of equipment is generally needed when two or more heating units are vented to the outside of the building through a common vent/duct, as depicted in FIG. 1. For example, if a first unit 12*a* is operating, and second and third units 12*b* and 12*c* are not operating, the flue gases from the first unit 12*a* could flow through the common exhaust network 18 and into the other two heating units 12*b* and 12*c*. This potential flow of exhaust gases into the non-operating second and third units 12*b* and 12*c* can cause equipment failures or leakage of flue gases into the occupied building space. Thus, the flue dampers 20 are provided and are designed to close when their respective heating units are not operating.

Figure 2:
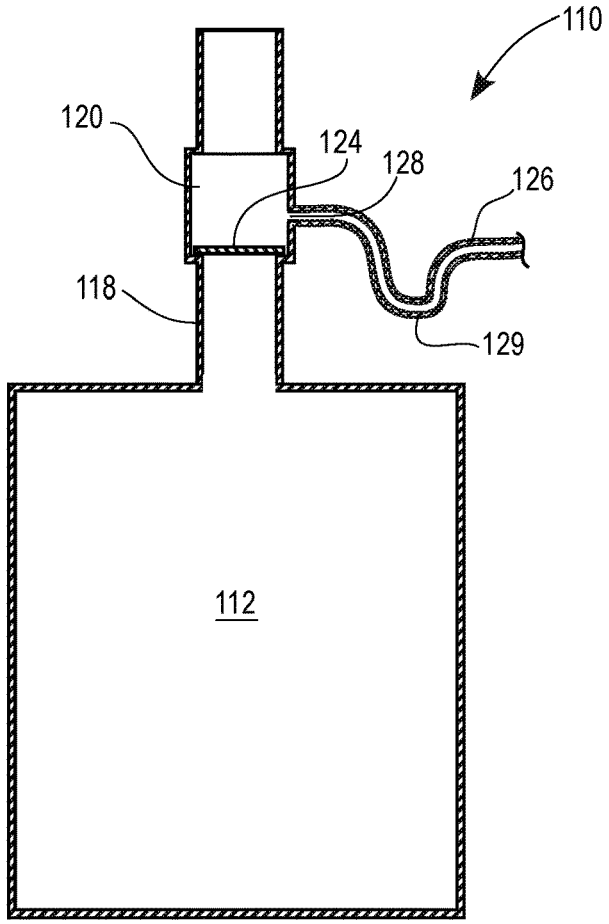
FIG. 2 is an illustration showing a heating system with a flue damper including a drainage pipe in accordance with certain aspects of the present disclosure.

FIG. 2, of which certain aspects may be prior art, is an illustration of an embodiment of a heating system 110 with a flue damper 120 in communication with a vent 118. As shown, the heating system 110 includes a heating appliance 122 (such as a water-heater or another suitable heater), and the flue damper 120 may selectively control flow of gasses (such as exhaust gasses) through the vent 118, which may lead to an external environment outside of a building. Under some conditions, such as when the temperature within the flue damper 120 and/or the vent 118 is lower than the point at which the internal gasses begin to become saturated with water vapor, condensate (which is typically water) may collect within the flue damper 120, particularly when a damper gate 124 of the flue damper 120 is closed (as shown in FIG. 2).

Without intervention, the condensate may build on top of the damper gate 124. This may be problematic since it can increase the force needed to open the damper gate 124 due to the weight of the condensate (e.g., water pressure) on top of the damper gate 124. In other words, without intervention, a motor or other device coupled to the damper gate 124 for mechanically opening and/or closing the damper gate 124 must be able to lift the damper gate 124 along with the condensate located above the damper gate 124 such that the condensate could drain through the vent 118 and into the heating appliance 112 (which typically includes its own means of dealing with condensates and other liquids). This is problematic since, without reducing the size of the motor coupled to the damper gate 124 (which also increases costs), the motor may be incapable of opening the damper gate 124 when collected condensate reaches a certain level. Failure of the damper gate 124 to open may interrupt the heating process (due to automatic shut-down of the heating system 110) and/or may create a safety hazard if exhaust gasses cannot escape through the vent 118.

To address this issue, the heating system 110 of FIG. 2 includes the drainage pipe 126. The drainage pipe 126 may include an inlet 128 located at the bottom of the flue damper 120, as shown, such that condensate flows out of the flue damper 120 when it reaches a certain level (e.g., such that buoyancy overcomes gravitational force). The drainage pipe 126 may have include an optional drain trap 129 (e.g., a curved portion of the drainage pipe 126) to create a water seal within the pipe, particularly if the drainage pipe 126 leads to a sewer system or other system for disposing of wastewater. Optionally, the drainage pipe 126 may lead to an outlet located in a wastewater system (e.g., a sewer system) for disposing of the condensate, and/or the condensate may flow into the heating appliance 112.

Figure 3:
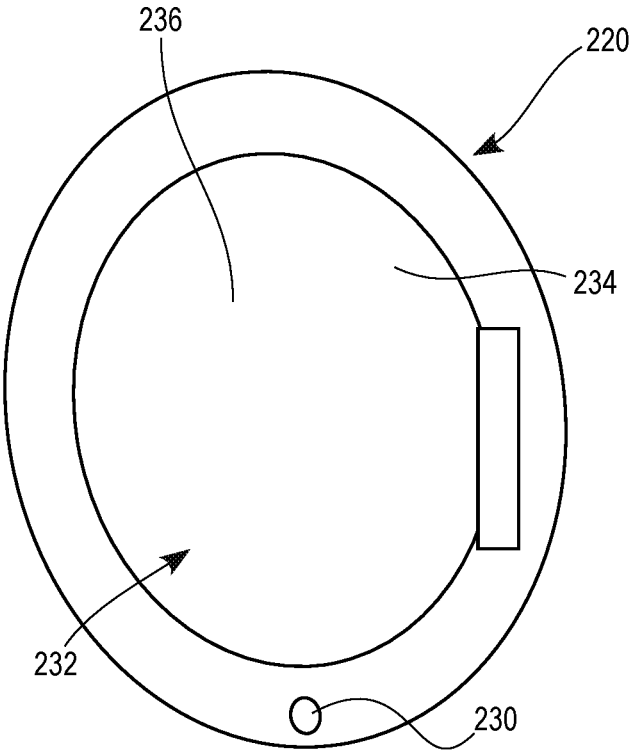
FIG. 3 is an illustration showing a damper gate and a lower housing portion of a flue damper, where the lower housing portion includes a drainage port in accordance with certain aspects of the present disclosure.

FIG. 3 is an illustration showing an embodiment of a flue damper 220 that has a drainage port 230 for addressing collected condensate. The drainage port 230 may include a plug for selectively opening and closing the drainage port 230, as described below (e.g., with reference to FIGS. 9-11). As shown in FIG. 3, the drainage port 230 may be located on a surface 232 of a lower housing portion 234 of the flue damper 220, and optionally, the surface 232 may be a sealing surface that abuts a bottom side of a damper gate 236 when the damper gate 236 is in a closed state (as shown). The drainage port 230 may include an opening that bypasses the damper gate 236 such that, when the drainage port 230 is opened, the drainage port 230 allows condensate or other collected liquid to flow through the drainage port 230 into a lower portion of the vent pipe, and/or to a separate drainage pipe that leads to a wastewater system.

Figure 4:
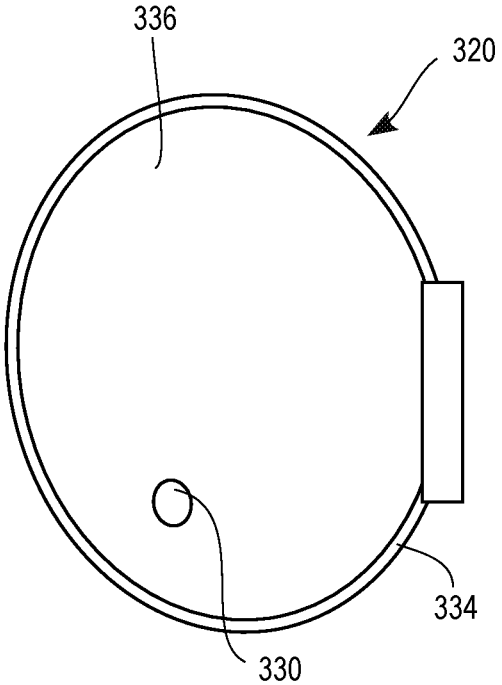
FIG. 4 is an illustration showing a damper gate having a drainage port in accordance with certain aspects of the present disclosure.

FIG. 4 is an illustration showing an embodiment of a flue damper 320 that is similar to the flue damper 220 of FIG. 3, but with one primary difference: the drainage port 330 of the flue damper 320 (of FIG. 4) is located on the damper gate 336 of the flue damper 320 rather than on another component (such as the lower housing portion 334). Like the embodiment described above, the drainage port 330 may include an opening that bypasses the remainder of the damper gate 336 such that, when the drainage port 330 is opened, the drainage port 330 allows condensate or another collected liquid to flow through the drainage port 330 into a lower portion of the vent pipe, and/or to a separate drainage pipe that leads to a wastewater system. This may be advantageous for reducing the size of peripheral areas of the lower housing portion 334 relative to other embodiments, for example.

Figures 5, 6, 7:
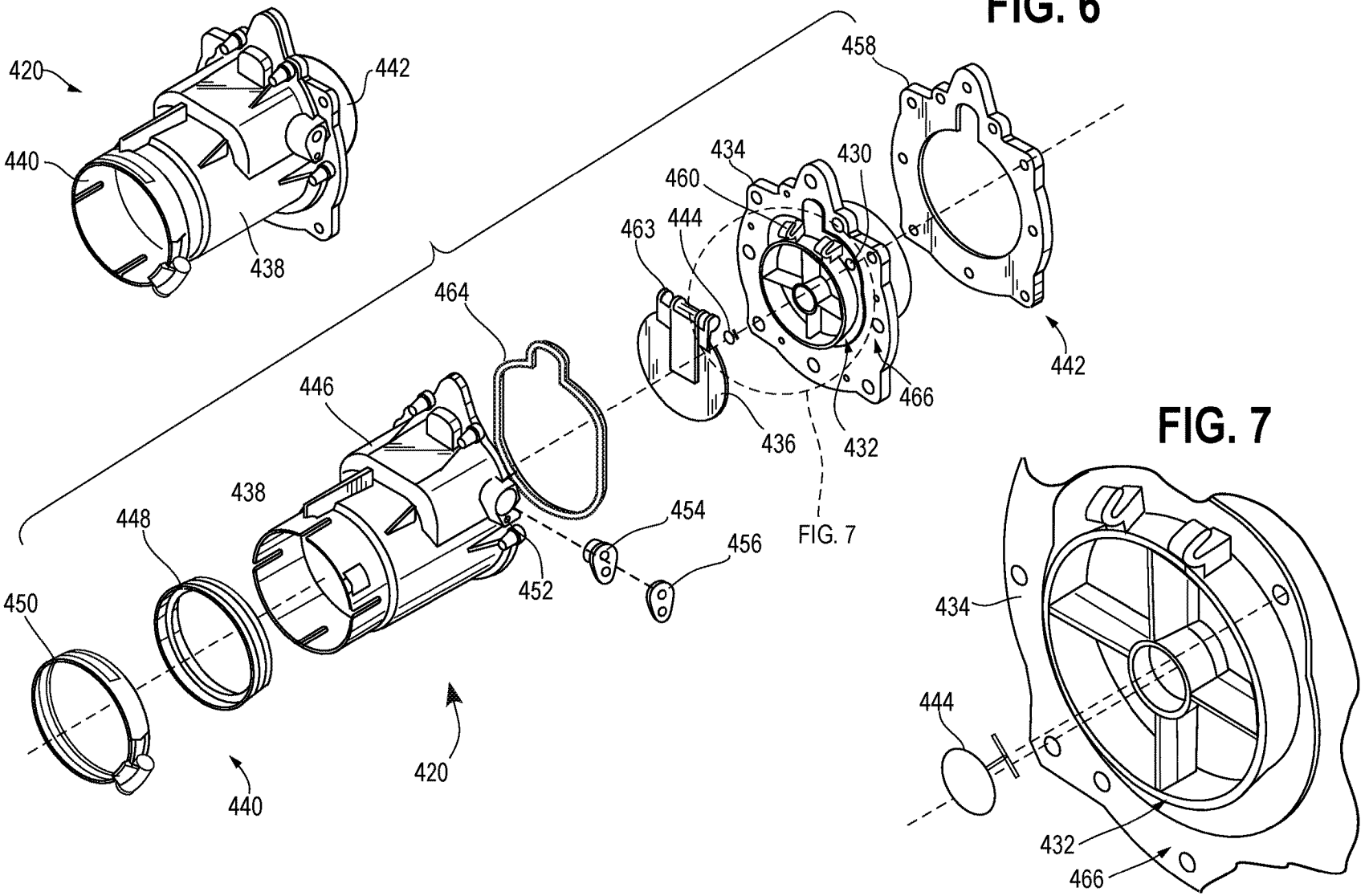
FIG. 5 is an illustration showing a perspective view of a flue damper in accordance with certain aspects of the present disclosure.
FIG. 6 is an illustration showing exploded view of the flue damper of FIG. 5.
FIG. 7 is a close-up view of a portion of the flue damper of FIG. 6 about callout C, showing a drainage port extending through a lower housing portion in accordance with certain aspects of the present disclosure.

FIG. 5 is an illustration showing a perspective view of a flue damper 420. The flue damper 420 may form at least a portion of a vent pipe 438 for removing exhaust gasses from a heating appliance. A first side 440 of the flue damper 420 may lead to the external environment, and a second side 442 may lead to the heating appliance.

FIG. 6 is an illustration showing an exploded view of the flue damper 420, and FIG. 7 is a close-up view of a lower housing portion 434, drainage port 430, and plug 444 of the flue damper 420. The remaining elements of the flue damper 420 may include an upper housing portion 446 which forms a portion of a vent-pipe (as described above), such as the outer walls of the vent pipe. An internal seal 448 and clamp 450 may be included to seal the upper housing portion 446 relative to another portion of the vent (not shown) leading to an external environment. An accessory port 452, along with an accessory port seal 454 and cover 456, may be included (e.g., for providing access for an accessory, such as a sensor). A formed seal 464 may provide sealing between the upper housing portion 446 and a lower housing portion 434. The damper gate 436 may be pivotally secured to the lower housing portion 434 at a pivot point 460 (which couples to the hinge 463). When assembled, the damper gate 436 may have an open state and a closed state, where in the open state, the first side 440 of the vent pipe 438 is in fluid communication with the second side 442, and where in the closed state, the damper gate 436 interrupts fluid communication between the first side 440 and the second side 442 of the vent pipe 438. The lower housing portion 434 may include a seal surface 432 that abuts the damper gate 436 when the damper gate 436 when the damper gate 436 is in the closed state, thus interrupting flow of fluids through the flue damper 420. Finally, a lower seal 458 may provide sealing between the lower housing portion 434 and another portion of the vent (not shown) leading to the heating appliance. These components are included as examples only, and additional components may be included, and/or certain components may be left out.

As shown in FIGS. 6-7, the drainage port 430 may be included in the lower housing portion 434, and the drainage port 430 may be offset from the damper gate 436 (as shown). As a result, the drainage port 430 may be openable or closable (e.g., through operation of a plug 444) even when the damper gate 436 remains in the closed state. Further, the drainage port 430, as depicted, may be located on a bottom surface 466 (e.g., at a lower elevation than a sealing surface 432) such that condensate collected at the lowest elevation of the flue damper 420 is removed, which may be advantageous for ensuring all condensate within the flue damper 420 is removable assuming the condensate can flow from any location within the flue damper 420 to the lowest elevation at the bottom surface 466.

Figure 8:
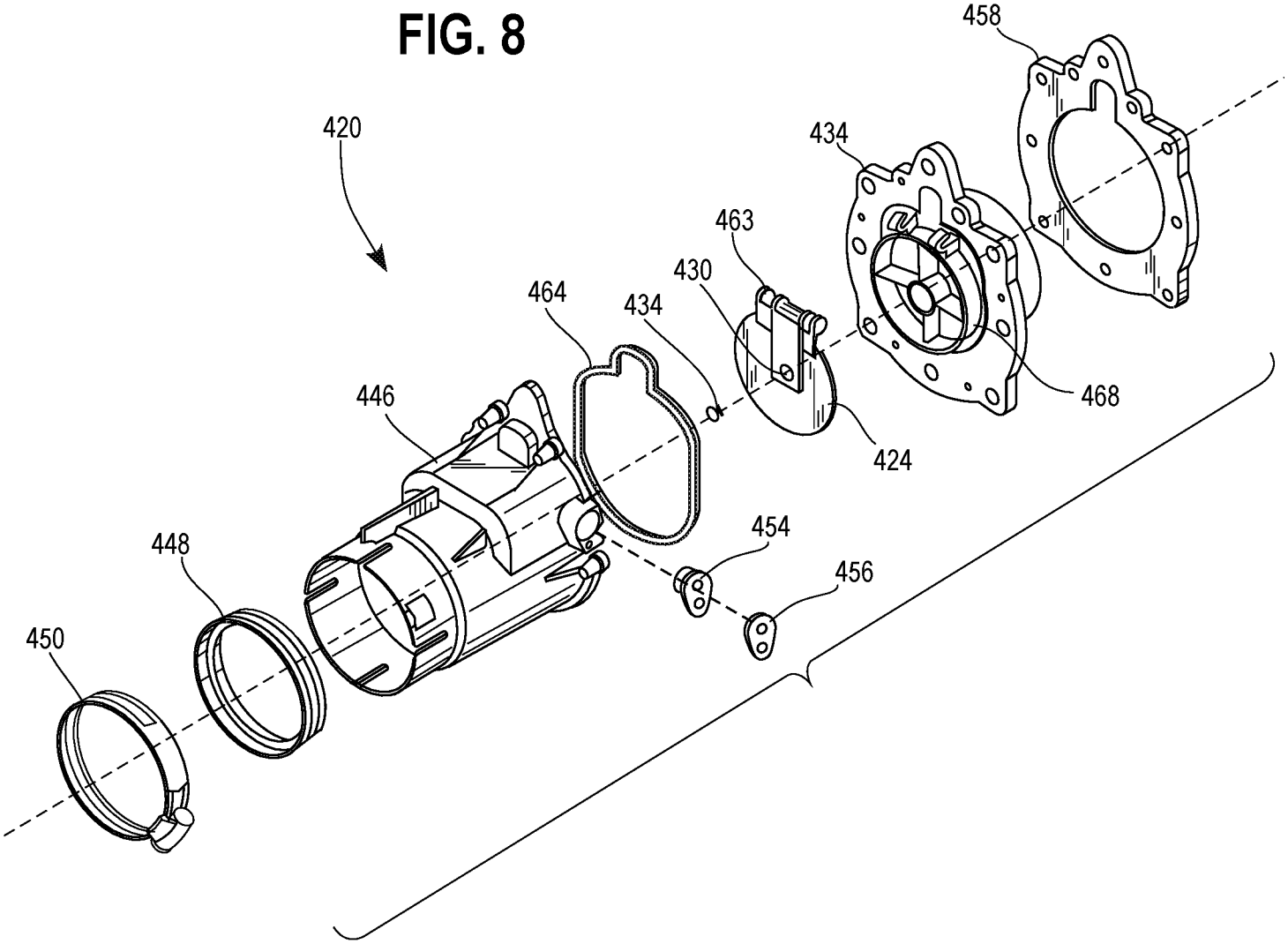
FIG. 8 is an illustration showing an exploded view of a flue damper having a damper gate with a drainage port in accordance with certain aspects of the present disclosure.

FIG. 8 is an illustration showing a flue damper 420 that is similar to that of FIGS. 5-7 (and each reference number described above with reference to FIGS. 5-7 also applies to elements of FIG. 8, unless stated otherwise). The primary difference between the embodiments of FIGS. 5-7 and FIG. 8 is that the embodiment of FIG. 8 includes a drainage port 430 that has an opening extending through the damper gate 424 rather than through the lower housing portion 434. The plug 444 may extend at least partially through the opening of the drainage port 430 such that condensate can be selectively drained directly through the damper gate 436. Advantageously, by providing the drainage port 430 on the damper gate 436, a peripheral area 468 around the damper gate 436 not be necessary (e.g., since the drainage port 430 does not require space on the lower housing portion 434), thus potentially reducing the overall cross-sectional size of the flue damper 420 relative to other embodiments. In this embodiment, when the damper gate 436 moves (e.g., from a closed state to an open state), the drainage port 430 and the plug 444 may move with it.

Figure 9:
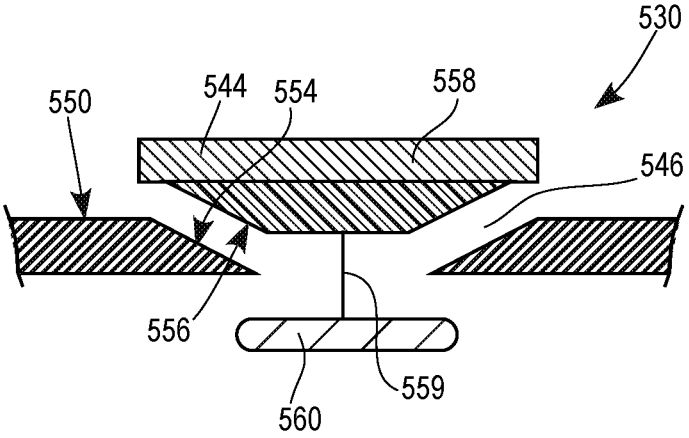
FIG. 9 is an illustration showing an embodiment of a drainage port with a plug having a float in accordance with certain aspects of the present disclosure.
Figure 10:
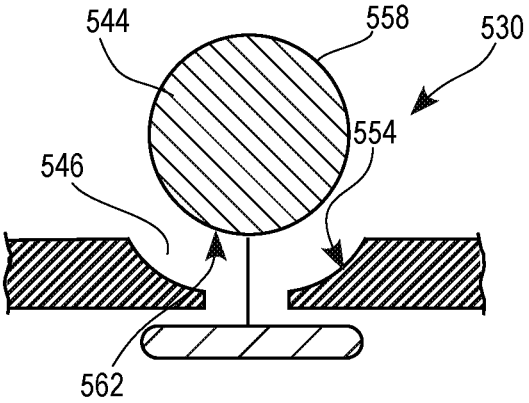
FIG. 10 is an illustration showing another embodiment of a drainage port with a plug having a float in accordance with certain aspects of the present disclosure.
Figure 11:
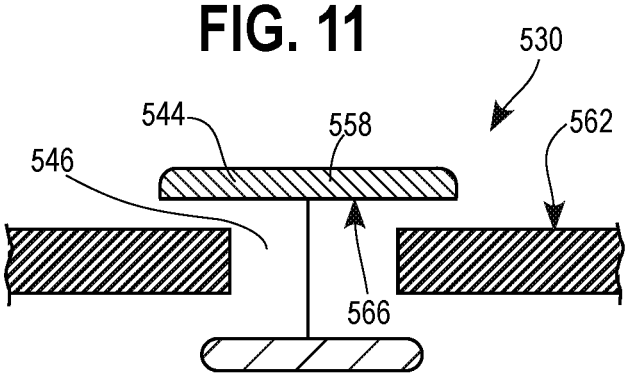
FIG. 11 is an illustration showing another embodiment of a drainage port with a plug having a float in accordance with certain aspects of the present disclosure.

A variety of drainage port(s) and/or plug(s) may be used with the above-described embodiments (and any other applicable embodiments). For example, four examples of drainage ports 530 with associated plugs 544 are shown in the illustrations of FIGS. 9-11. These embodiments could each be used in combination with the embodiments described above (e.g., where a drainage port is located on a damper gate, on a lower housing portion, etc.).

Referring to FIG. 9, the drainage port 530 may include a circular opening 546 for condensate drainage (e.g., when the condensate collects on the surface 550). An outer periphery of the opening 546 may be defined by a slanted seat surface 554, which is configured (e.g., sized, shaped, and positioned) for receiving corresponding slanted edges 556 of the plug 544. When the drainage port 530 is in a closed state, the slanted edges 556 of the plug 544 may abut the seat surface 554 of the drainage port 530, which may substantially seal the opening 546. To address the buildup of condensate or another liquid, the plug 544 may include a float 558. As the condensate collects, the buoyancy of the float 558 may provide an upward-force on the plug 544 such that the plug 544 lifts away from the opening 546. Once the condensate reaches a certain level (e.g., 1 inch or less, such as 0.5 inches or less, or 0.25 inches or less), the force provided by the buoyancy of the float 558 may overcome the weight of the plug 544 (along with any other forces, such as a downward-facing force due to water pressure), thus causing the plug 544 to lift such that the drainage port 530 at least partially opens. Once the drainage port 530 is at least partially opened, the condensate can flow therethrough.

The float 558 may include any suitable structure. For example, in some embodiments, the float 558 may be formed as a hollow structure with an air pocket filled with air (or another gas), or the pocket may include a vacuum, such that the overall density of the float 558 is substantially lower than the density of water (or another liquid). The float 558 may alternatively or additionally include a foam, a buoyant plastic, or any other suitable material.

To retain the plug 544 at the drainage port 530, the plug 544 may include a retainer 559 that extends at least partially through the opening 546. The retainer 559 may have an end portion 560 that has a dimension (e.g., a length L) that is larger than a cross-sectional dimension (e.g., a damager) of the opening 546. Since the end portion 560 cannot readily fit through the opening 546, when the float 558 of the plug 544 raises away from the opening 546, the end portion 560 of the retainer 559 may retain the plug 544 at the drainage port. This is also advantageous when the drainage port 530 is located on a damper gate that undergoes significant movements during flue damper operation (e.g., as shown in FIG. 4 and FIG. 6).

FIGS. 10-11 show embodiments of drainage ports similar to that of FIG. 9, but with plugs having a different shape. For example, in FIG. 10, the plug 544 may include a spherical float 558, and an opening 546 of an associated drainage port 530 may include a seat surface 554 that mirrors the outer surface 562 of the spherical float 558. In FIG. 10, a seat surface 554 may be defined by a top surface 564 that contacts a bottom surface 566 of the float 558 (e.g., such that no dedicated seat surface is required). Any other suitable shape of a plug and/or a drainage port could be used.

Figure 12:
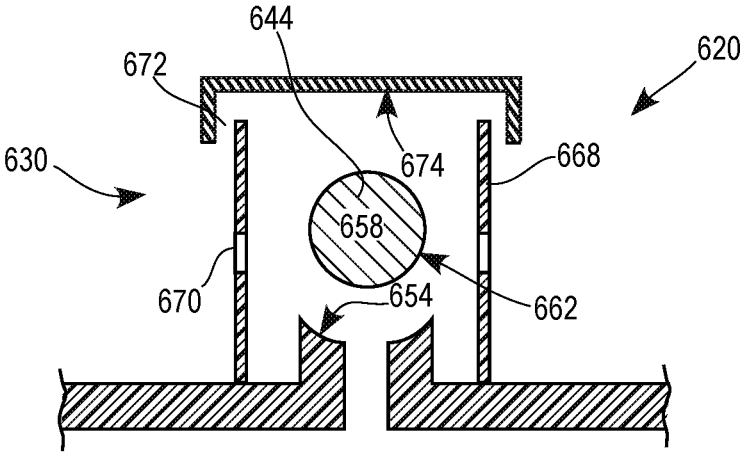
FIG. 12 is an illustration showing a drainage port with a retention housing for retaining a plug in accordance with certain aspects of the present disclosure.

FIG. 12 is an illustration showing a drainage port 630 that includes a retention housing 668. In this embodiment, the plug 644 includes a float 658 but lacks a separate retention mechanism. Retention of the plug 644 is instead provided by the retention housing 668, which may substantially surround the plug 644. When condensate collects within a flue damper 620, it may flow into the retention housing 668 through one or more openings 670. Ventilation may be provided by vents 672 (e.g., such that air within the retention housing 668 can flow out as condensate flows in. However, movement of the float 658 may be limited by the inner surfaces 674 of the retention housing 668, therefore keeping the plug 644 in place. Any openings within the retention housing 668 may be small enough such that the plug 644 cannot readily escape. As condensate drains, an outer surface 662 of the plug 644 may move towards, and eventually abut, a seat surface 654 located at the bottom of the retention housing 668 to close the drainage port 630.

While each of the embodiments described herein includes a plug with a float, it is also contemplated that certain plugs may lack a float. For example, in some embodiments, a plug may include an electromechanical device that opens and closes the drainage port via a motor (e.g., in response to condensate being detected by a sensor). In other embodiments, the plug may include a manual actuator that is operated in response to a user input (e.g., through direct force, through an input to a control system, etc.). Further, the flue dampers described herein include only one drainage port, but multiple may be included. For example, multiple drainage ports may be included on a damper gate, on an outer periphery (e.g., on a lower housing portion), both, or in another suitable location.

Having described various aspects of the subject matter, additional disclosure is provided below, which includes certain aspects consistent with the originally-filed claims located at the end of this specification.

In a first aspect, a flue damper may include one or more of the following: a vent pipe with a first side leading to an outlet of the flue damper and a second side leading to an inlet of the flue damper; a damper gate with an open state and a closed state, where in the open state, the first side of the vent pipe is in fluid communication with the second side, and where in the closed state, the damper gate interrupts fluid communication between the first side and the second side; a drainage port; and a plug that is movable relative to the drainage port to selectively seal the drainage port when the damper gate remains in the closed state.

The drainage port may be located on an upper surface of the damper gate.

A lower housing portion may be included, where the drainage port is located on an upper surface of the lower housing portion, and where the damper gate is movable relative to the lower housing portion.

The plug may be configured to float within condensate to move away from the drainage port when the condensate collects within the first side of the vent pipe.

A lower surface of the plug may contact a seat surface of the drainage port when the plug is in a closed sealing state.

The plug may include a retainer extending at least partially through an opening formed by the drainage port. The retainer may include an end portion having a dimension that is larger than a cross-sectional dimension of the opening formed by drainage port.

The flue damper may further include a housing aligned with the drainage port, where an interior of the housing is in fluid communication with an exterior of the housing, and where the plug is located inside the interior of the housing.

In a second aspect, a flue damper may include one or more of the following: a vent pipe with a first side leading to an outlet of the flue damper and a second side leading to an inlet of the flue damper; a damper gate with an open state and a closed state, where in the open state, the first side of the vent pipe is in fluid communication with the second side, and where in the closed state, the damper gate interrupts fluid communication between the first side and the second side; and a drainage port, where the drainage port forms an opening extending through the damper gate.

A plug may be included that is movable relative to the drainage port so selectively seal the drainage port. The plug may be configured to float within condensate to move away from the drainage port when the condensate collects within the first side of the vent pipe. A lower surface of the plug may contact a seat surface of the drainage port when the plug is in a closed sealing state. The plug may include a retainer extending through the opening formed by the drainage port. The retainer may include an end portion having a dimension that is larger than a cross-sectional dimension of the opening formed by drainage port.

In another aspect, a flue damper may include one or more of the following: a vent pipe with a first side leading to an outlet of the flue damper and a second side leading to an inlet of the flue damper; a damper gate with an open state and a closed state, where in the open state, the first side of the vent pipe is in fluid communication with the second side, and where in the closed state, the damper gate interrupts fluid communication between the first side and the second side; a drainage port; and a lower housing portion having a sealing surface that abuts the damper gate when the damper gate is in the closed state, where the drainage port forms an opening that extends through the lower housing portion.

A plug may be included that is movable relative to the drainage port to selectively seal the opening when the damper gate remains in the closed state. The plug may be configured to float within condensate to move away from the drainage port when the condensate collects within the first side of the vent pipe. A lower surface of the plug may contact a seat surface of the drainage port when the plug is in a closed sealing state. The plug may include a retainer extending at least partially through the opening formed by the drainage port. The retainer may include an end portion having a dimension that is larger than a cross-sectional dimension of the opening formed by the drainage port.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. A flue damper, comprising:

a vent pipe with a first side leading to an outlet of the flue damper and a second side leading to an inlet of the flue damper;

a damper gate coupled, via a hinge, to a portion of the flue pipe, the damper gate comprising an open state and a closed state, wherein in the open state, the first side of the vent pipe is in fluid communication with the second side, and wherein in the closed state, the damper gate interrupts fluid communication between the first side and the second side;

a drainage port; and a plug that is movable relative to the drainage port to selectively seal the drainage port when the damper gate remains in the closed state.

2. The flue damper of claim 1, wherein the drainage port is located on an upper surface of the damper gate.

3. The flue damper of claim 1, further comprising a housing portion that is coupled to the vent pipe and that is positioned between the first side and the second side, wherein the drainage port extends through the housing portion, and wherein the damper gate is hingedly movable relative to the housing portion.

4. The flue damper of claim 1, wherein the plug is configured to float within condensate to move away from the drainage port when the condensate collects within the first side of the vent pipe.

5. The flue damper of claim 1, wherein a lower surface of the plug contacts a seat surface of the drainage port when the plug is in a closed sealing state.

6. The flue damper of claim 1, wherein the plug includes a retainer extending at least partially through an opening formed by the drainage port.

7. The flue damper of claim 6, wherein the retainer includes an end portion having a dimension that is larger than a cross-sectional dimension of the opening formed by drainage port.

8. The flue damper of claim 1, further comprising: a housing aligned with the drainage port, wherein an interior of the housing is in fluid communication with an exterior of the housing, and wherein the plug is located inside the interior of the housing.

9. A flue damper, comprising:

a vent pipe with a first side leading to an outlet of the flue damper and a second side leading to an inlet of the flue damper;

a damper gate coupled, via a hinge, to a portion of the flue pipe, the damper gate comprising an open state and a closed state, wherein in the open state, the first side of the vent pipe is in fluid communication with the second side, and wherein in the closed state, the damper gate interrupts fluid communication between the first side and the second side; and a drainage port, wherein the drainage port forms an opening extending through the damper gate.

10. The flue damper of claim 9, further comprising a plug that is movable relative to the drainage port to selectively seal the drainage port.

11. The flue damper of claim 10, wherein the plug is configured to float within condensate to move away from the drainage port when the condensate collects within the first side of the vent pipe.

12. The flue damper of claim 10, wherein a lower surface of the plug contacts a seat surface of the drainage port when the plug is in a closed sealing state.

13. The flue damper of claim 10, wherein the plug includes a retainer extending through the opening formed by the drainage port.

14. The flue damper of claim 13, wherein the retainer includes an end portion having a dimension that is larger than a cross-sectional dimension of the opening formed by drainage port.

15. A flue damper, comprising:

a vent pipe with a first side leading to an outlet of the flue damper and a second side leading to an inlet of the flue damper;

a housing that is coupled to the vent pipe and that is positioned between the first side and the second side, the housing comprising:

an opening fluidly connecting the first side and the second side; and a wall peripheral to the opening;

a damper gate coupled to the housing and comprising an open state and a closed state, wherein in the open state, the first side of the vent pipe is, via the opening, in fluid communication with the second side, and wherein in the closed state, the damper gate, by covering the opening, interrupts fluid communication between the first side and the second side;

a drainage port extending through the wall of the housing, wherein the drainage port is offset from the damper gate and the opening.

16. The flue damper of claim 15, further comprising a plug that is movable relative to the drainage port to selectively seal the drainage port when the damper gate remains in the closed state.

17. The flue damper of claim 16, wherein the plug is configured to float within condensate to move away from the drainage port when the condensate collects within the first side of the vent pipe.

18. The flue damper of claim 16, wherein a lower surface of the plug contacts a seat surface of the drainage port when the plug is in a closed sealing state.

19. The flue damper of claim 16, wherein the plug includes a retainer extending at least partially through the drainage port.

20. The flue damper of claim 19, wherein the retainer includes an end portion having a dimension that is larger than a cross-sectional dimension of the drainage port.

* * * * *